US006797226B2

(12) United States Patent
Annable

(10) Patent No.: US 6,797,226 B2
(45) Date of Patent: Sep. 28, 2004

(54) PROCESS OF MAKING MICROCREPED WIPERS

(75) Inventor: Patricia A. Annable, Berwick-upon-Tweed (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 318 days.

(21) Appl. No.: 09/973,666

(22) Filed: Oct. 9, 2001

(65) Prior Publication Data

US 2002/0134493 A1 Sep. 26, 2002

Related U.S. Application Data

(60) Provisional application No. 60/240,868, filed on Oct. 10, 2000.

(51) Int. Cl.[7] ..... B31F 1/12; D04H 3/16

(52) U.S. Cl. ..... 264/555; 26/18.6; 156/183; 162/111; 264/103; 264/282; 264/283

(58) Field of Search ..... 264/103, 168, 264/282, 283, 555; 156/183; 162/111; 26/18.6

(56) References Cited

U.S. PATENT DOCUMENTS

| | | | | |
|---|---|---|---|---|
| 3,260,778 A | | 7/1966 | Walton | |
| 3,338,992 A | | 8/1967 | Kinney | |
| 3,341,394 A | | 9/1967 | Kinney | |
| 3,502,763 A | | 3/1970 | Hartman | |
| 3,542,615 A | | 11/1970 | Dobo et al. | |
| 3,692,618 A | | 9/1972 | Dorschner et al. | |
| 3,802,817 A | | 4/1974 | Matsuki et al. | |
| 3,849,241 A | | 11/1974 | Butin et al. | |
| 3,855,046 A | | 12/1974 | Hansen et al. | |
| 3,949,128 A | * | 4/1976 | Ostermeier | 428/152 |
| 3,971,373 A | | 7/1976 | Braun | |
| 4,003,783 A | | 1/1977 | Groome et al. | |
| 4,100,324 A | | 7/1978 | Anderson et al. | |
| 4,118,531 A | | 10/1978 | Hauser | |
| 4,340,563 A | | 7/1982 | Appel et al. | |
| 4,795,668 A | | 1/1989 | Krueger et al. | |
| 4,841,958 A | | 6/1989 | Ersfeld et al. | |
| 4,902,559 A | | 2/1990 | Eschwey et al. | |
| 4,919,877 A | | 4/1990 | Parsons et al. | |

(List continued on next page.)

FOREIGN PATENT DOCUMENTS

| | | |
|---|---|---|
| EP | 0120564 B1 | 1/1970 |
| EP | 0411752 B1 | 7/1995 |
| EP | 0492554 B1 | 11/1995 |
| WO | WO 9612615 A1 | 5/1996 |
| WO | WO 9920822 A1 | 4/1999 |

OTHER PUBLICATIONS

Japan Abstract JP5179545 A (Jul. 20, 1993).

Kimberly–Clark Nonwoven Fabrics *Meltblown—both a filter and a reservoir* (1999).

Kimberly–Clark Nonwoven Fabrics *Spunbond—the foundation of many nonwoven products and processes* (1999).

German Abstract DE 2513251 A Sep. 30, 1976.

Japan Abstract JP 48033173 A 7167126 A May 8, 1973.

Micrex Corporation *Compressive Treatment Process for Non–Wovens and Paper*, undated.

Micrex Corporation, undated.

*Primary Examiner*—Leo B. Tentoni
(74) *Attorney, Agent, or Firm*—Dority & Manning, P.A.

(57) ABSTRACT

A method for forming a wiping product. In particular, the wiping product contains a fabric formed from a nonwoven web that is bonded by microcreping at least one side of the web. The nonwoven web can contain melt-spinnable fibers, such as polyolefins, as well as various other fibers, such as pulp fibers, staple fibers, etc. For example, the nonwoven web can contain at least about 20% by weight of polyolefin fibers. By bonding the web using microcreping, the resulting bulk, absorption capacity, and softness of the fabric can be improved.

43 Claims, 2 Drawing Sheets

U.S. PATENT DOCUMENTS

| | | | |
|---|---|---|---|
| 5,057,368 | A | 10/1991 | Largman et al. |
| 5,069,970 | A | 12/1991 | Largman et al. |
| 5,102,606 | A | 4/1992 | Ake et al. |
| 5,108,820 | A | 4/1992 | Kaneko et al. |
| 5,277,976 | A | 1/1994 | Hogle et al. |
| 5,336,552 | A | 8/1994 | Strack et al. |
| 5,382,400 | A | 1/1995 | Pike et al. |
| 5,466,410 | A | 11/1995 | Hills |
| 5,498,232 | A | 3/1996 | Scholz |
| 5,952,251 | A | 9/1999 | Jackson et al. |
| 5,972,039 | A | 10/1999 | Honeycutt et al. |
| 6,080,466 | A | 6/2000 | Yoshimura et al. |
| 6,197,404 | B1 | 3/2001 | Varona |
| 6,214,146 | B1 | 4/2001 | Merker |
| 6,375,889 | B1 | 4/2002 | Holmes et al. |
| 6,534,151 | B2 | 3/2003 | Merker |
| 6,592,697 | B2 | 7/2003 | Pike et al. |

* cited by examiner

PROCESS OF MAKING MICROCREPED WIPERS

RELATED APPLICATIONS

The present application claims priority to a provisional application filed on Oct. 10, 2000 having Ser. No. 60/240,868.

BACKGROUND OF THE INVENTION

Absorbent products such as industrial wipers, food service wipers, and other similar items are designed to combine several important attributes. For example, the products should have good bulk, a soft feel and should be highly absorbent. The products should also have good strength even when wet and should resist tearing. Further, the wiping products should have good stretch characteristics and should not deteriorate in the environment in which they are used.

In the past, many attempts have been made to enhance and increase certain physical properties of wiping products. Unfortunately, however, when steps are usually taken to increase one property of a wiping product, other characteristics of the product may be adversely affected. For instance, in some wiping products, strength can be increased by embossing the web to thermally bond fibers contained therein. However, in certain instances, such thermal bonding can result in a web that contains substantial areas of melted polymer. Typically, these areas have a decreased functionality, i.e., absorption capacity, bulk, etc.

As such, a need currently exists for a method for bonding a wiping product such that it can have improved functionality and also remain relatively strong.

SUMMARY OF THE INVENTION

The present invention is generally directed to fabrics formed from nonwoven webs that are bonded by microcreping. In particular, it has been discovered that the frictional forces associated with microcreping can cause the fibers within a web to bond together to provide web strength. Moreover, it has also been discovered that microcreping does not generally result in a web having substantial areas of melted polymer such that the web can have improved functionality, i.e., absorption capacity, bulk, etc.

Nonwoven webs used in the present invention can generally be formed from any of a variety of materials, such as various materials commonly used in the art for making wipers. In particular, a nonwoven web of the present invention is typically made from synthetic fibers, pulp fibers, thermomechanical pulp, or mixtures thereof. For instance, in one embodiment, the nonwoven web can be made exclusively from polyolefin fibers. In another embodiment, the nonwoven web can be made from polyolefin fibers and pulp fibers. When utilizing synthetic fibers, such as polyolefin fibers, in conjunction with pulp fibers, the synthetic fibers can generally be added to the web in any desired amount. For example, in one embodiment, polyolefin fibers are added in an amount of at least about 20% by weight of the web, particularly at least about 40% by weight of the web, and more particularly at least about 60% by weight of the web.

In one particular embodiment, the nonwoven web of the present invention is formed from melt-spun fibers. For example, in one embodiment, the nonwoven web is formed by meltblowing polyolefins or other melt-spinnable fibers into a web formation. In another embodiment, a coform web can be formed by combining melt-spun fibers with pulp fibers, staple fibers, etc., during a meltblowing or spunbonding process. Moreover, if desired, a multi-layered nonwoven web can be formed that contains a first layer formed from a meltblown, spunbond, or coform material and a second layer formed from any other material. For instance, the second layer can be formed from a meltblown, spunbond, coform, or bonded carded material.

In accordance with the present invention, after forming the fibers into a web, the web can then be bonded to improve the strength of the web. In particular, a nonwoven web of the present invention is bonded by microcreping, which is a mechanical compaction process normally used in the art to soften a web. It has also been discovered that microcreping can provide increased bulk and absorbent capacity, while also imparting sufficient strength to the web so that it may be used as a wiper. In one embodiment, for instance, the nonwoven web can be transferred to a treatment zone for microcreping one or both sides of the web. One or more blades may then be utilized to compact the web along at least one of its planar dimensions. For example, in one embodiment, the web can first pass under a primary blade that compresses it in the -z plane (i.e., the plane generally perpendicular to the plane formed by the machine direction and cross-machine direction. As the web passes under the primary blade, it can also contact one or more blades that compress the web in a lengthwise direction. Suitable microcreping equipment may be obtained, for example, from Micrex Corporation of Walpole, Mass.

In general, the extent of microcreping can vary as desired. In particular, by increasing the degree of microcreping, the bulk of the nonwoven web can be increased. However, it is typically desired to control the extent of microcreping so that the strength of the web is also not substantially reduced. For example, in some embodiments, the microcreped nonwoven web can have an extensibility in the lengthwise direction of less than about 30%, and particularly between about 5% to about 25%.

As a result of being bonded by microcreping, the bulk of a nonwoven web of the present invention can generally be increased due to micro-fold formation. Moreover, microcreping can also allow the nonwoven web to have improved absorbency characteristics over nonwoven webs bonded solely by other methods.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
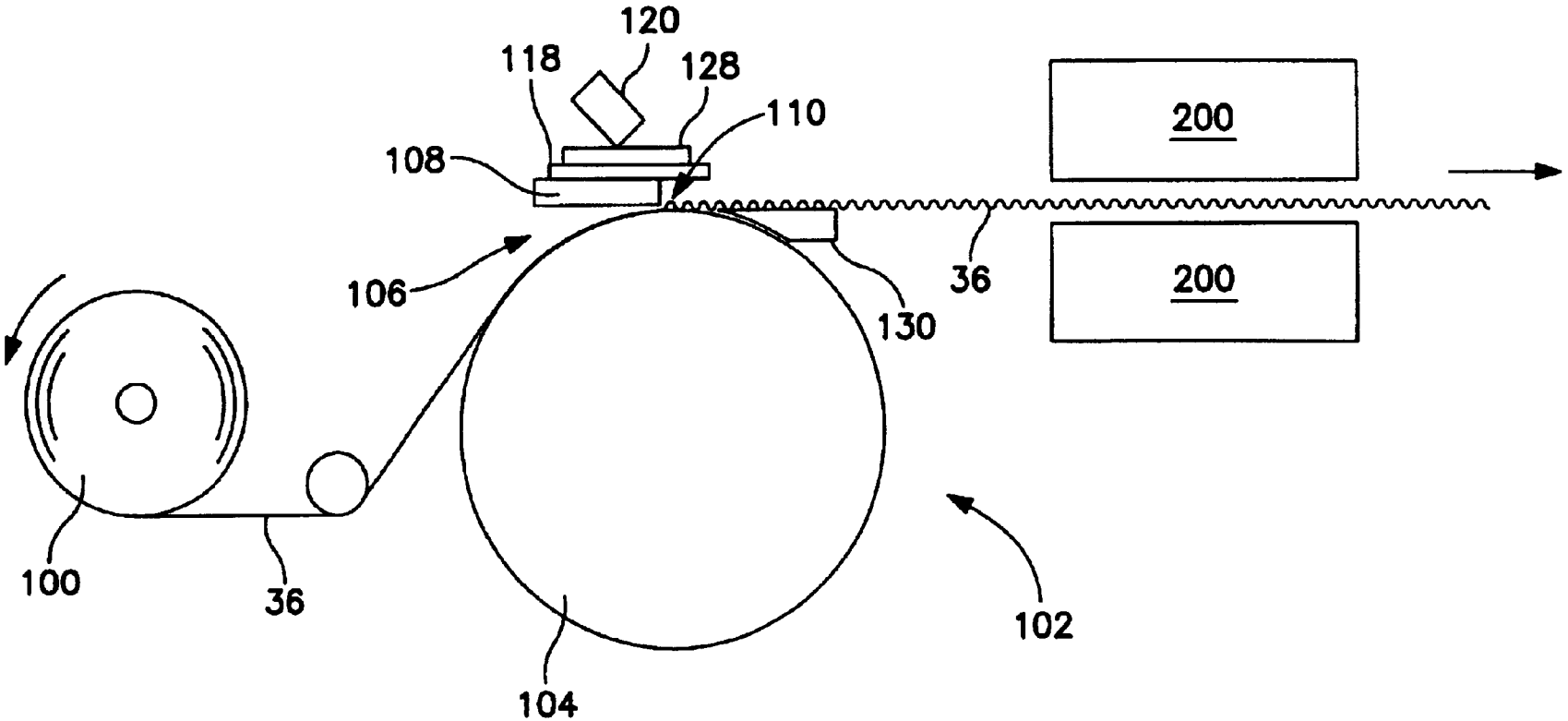
FIG. 1 is a schematic view illustrating one embodiment of the process of the present invention.

Repeat use of reference characters in the present specification and drawings is intended to represent same or analogous features or elements of the present invention.

DETAILED DESCRIPTION OF REPRESENTATIVE EMBODIMENTS

Definitions

As used herein, "bulk" is a measure of the thickness of a fabric. The bulk or thickness may be determined in accordance with ASTM D 5729-95 for Thickness of Nonwoven Fabrics using a three-inch acrylic plate that provides a 0.05 pounds per square inch loading.

As used herein the term "coform" generally refers to continuous melt-spun fibers intermixed with other fibers. For example, the melt-spun fibers can be intermixed with wood pulp fibers, such as disclosed in U.S. Pat. No. 4,100,324 to Anderson, et al., which is incorporated herein in its entirety by reference thereto for all purposes. Moreover, the melt-spun fibers can also be intermixed with staple length fibers, such as described in U.S. Pat. Nos. 4,118,531 to Hauser; 4,902,559 to Eschwey, et al.; and 5,952,251 to Jackson, et al., which are incorporated herein in their entirety by reference thereto for all purposes. Further the melt-spun fibers, in some instances, may be intermixed with superabsorbent particulates, such as described in U.S. Pat. No. 3,971,373 to Braun, which is incorporated herein in its entirety by reference thereto for all purposes. Currently, one common method of meltblown formation of coform nonwoven material involves injecting an amount of cellulose fibers or blends of cellulose fibers and staple fibers into a molten stream of meltblown fibers. Coform material injected into the fiber stream becomes entrapped or stuck to the molten fibers, which are subsequently cooled or set.

As used herein, the term "conjugate fibers" refers to fibers which have been formed from at least two polymers extruded from separated extruders but formed together into one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement, wherein one polymer is surrounded by another or may be a side-by-side arrangement, a pie arrangement or an "islands-in-the-sea" arrangement. Conjugate fibers are taught by U.S. Pat. Nos. 5,108,820 to Kaneko et al., and 4,795,668 to Krueger et al., 5,336,552 to Strack et al. Conjugate fibers are also taught in U.S. Pat. No. 5,382,400 to Pike et al. and may be used to produced crimp in the fibers by using the differential rates of expansion and contraction of the two (or more) polymers. Crimped fibers may also be produced by mechanical means and by the process of German Patent DT 25 13 251 A1. For two component fibers, the polymers may be present in ratios of 75/25, 50/50, 25/75, or any other desired ratios. The fibers may also have shapes such as those described in U.S. Pat. Nos. 5,277,976 to Hogle et al., 5,466,410 to Hill, 5,069,970 to Largman et al., and 5,057,368 to Largman et al., which describe fibers with unconventional shapes.

As used herein, the term "extensibility" generally refers to the ability of a material, upon application of a biasing force, to extend in the direction of the force. In particular, "extensibility" can be determined utilizing the grab tensile elongation test. The grab tensile elongation test is a measure of elongation of a fabric when subjected to unidirectional stress. This test is known in the art and conforms to the specifications of Method 5100 of the Federal Test Methods Standard 191A. The results are expressed in percent stretch before breakage. Values for grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model TM, available from the Instron Corporation, 2500 Washington St., Canton, Mass. 02021, or a Thwing-Albert Model INTELLECT II available from the Thwing-Albert Instrument Co., 10960 Dutton Rd., Philadelphia, Pa. 19154, which have 3 inch (76 mm) long parallel clamps. This closely simulates fabric stress conditions in actual use.

As used herein, the terms "machine direction" or "lengthwise direction" generally refers to the direction in which a fabric is produced (i.e., length). As used herein, the term "cross-machine direction" generally refers to the width of the fabric, i.e., a direction generally perpendicular to the machine direction.

As used herein, "meltblown fibers" refers to fibers formed by extruding a molten thermoplastic material through a plurality of fine, usually circular, die capillaries as molten threads or filaments into converging high velocity, usually hot gas (e.g., air) streams which attenuate the filaments of thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al., which is incorporated herein in its entirety by reference thereto for all purposes. Meltblown fibers are microfibers which may be continuous or discontinuous.

As used herein, the term "melt spinnable" or "melt-spun" generally refers to a fiber or fibers that are formed by meltblown or spunbond processes.

As used herein, the term "microfibers" means small diameter fibers having a diameter not greater than about 75 micrometers, for example, having a diameter of about 0.5 micrometers to about 50 micrometers. More particularly, microfibers may have a diameter from about 2 micrometers to about 40 micrometers. Another frequently used expression of fiber diameter is denier, which is defined as grams per 9000 meters of a fiber and may be calculated as fiber diameter in micrometers squared, multiplied by the density in grams/cc, multiplied by 0.00707. A lower denier indicates a finer fiber and a higher denier indicates a thicker or heavier fiber. For example, the diameter of a polypropylene fiber given as 15 micrometers may be converted to denier by squaring and then multiplying the result by 0.00707. Thus, a 15-micrometer polypropylene fiber has a denier of about 1.42. Outside the United States, the unit of measurement for average fiber diameter is more expressed as the "tex", which is defined as the grams per kilometer of fiber. "Tex" may be calculated as denier/9.

As used herein, the term "monocomponent" fiber refers to a fiber formed from one or more extruders using only one polymer. This is not meant to exclude fibers formed from one polymer to which small amounts of additives have been added for coloration, anti-static properties, lubrication, hydrophilicity, etc. These additives, e.g., titanium oxide for coloration, are generally present in an amount less than about 5 weight percent and more typically less than about 2 weight percent.

As used herein, the term "nonwoven web" or "nonwoven" refers to a web having a structure of individual fibers or threads which are interlaid, but not in an identifiable manner as in a knitted fabric. Nonwoven webs or fabrics can be formed from many processes, such as, for example, meltblowing processes, spunbonding processes, and bonded carded web processes. The basis weight of nonwoven fabrics is usually expressed in ounces of material per square yard (osy) or grams per square meter (gsm) and the fibers diameters are usually expressed in microns. (Note that to convert from osy to gsm, multiply osy by 33.91).

As used herein, "spunbond fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. Nos. 4,340,563 to Appel et al., 3,692,618 to Dorschner et al., 3,802,817 to Matsuki et al., 3,338,992 to Kinney, 3,341,394 to Kinney, 3,502,763 to Hartman, and 3,542,615 to Dobo et al., which are incorporated herein in their entirety by reference thereto for all purposes. Spunbond fibers are generally not tacky when they are deposited on a collecting surface. Spunbond fibers are generally continuous and have diameters larger than about 7 microns, and more particularly, between about 10 and 40 microns.

It should be noted that any given range presented herein is intended to include any and all lesser included ranges. For example, a range of from 45–90 would also include 50–90; 45–80; 46–89 and the like. Thus, the range of 95% to 99.999% also includes, for example, the ranges of 96% to 99.1%, 96.3% to 99.7%, and 99.91 to 99.999%.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for forming wiping products. In particular, a wiping product of the present invention is formed from a fabric containing a nonwoven web of fibrous material that is bonded by microcreping. It has been discovered that by microcreping the nonwoven fabric in accordance with the present invention, the resulting wiping product can also have improved functionality, i.e., bulk, absorbency, etc.

Nonwoven webs used in the present invention can generally be formed from any of a variety of fibrous materials, such as various materials commonly used in the art for making wipers. For example, in one embodiment, synthetic fibers or filaments, such as those made from thermoplastic polymers, can be used in the present invention. The synthetic fibers or filaments used in making the nonwoven web may have any suitable morphology and may include hollow or solid, straight, curled or crimped, single component, conjugate or biconstituent fibers or filaments, and blends or mixtures of such fibers and/or filaments, as are well known in the art. The fibers can be curled or crimped, for instance, by adding a chemical agent to the fibers or subjecting the fibers to a mechanical process. Curled or crimped fibers may create more entanglement and void volume within the web and further increase the amount of fibers oriented in the -z direction as well as increase web strength properties.

Some exemplary thermoplastics include, without limitation, poly(vinyl) chlorides, polyesters, polyamides, polyfluorocarbons, polyolefins, polyurethanes, polystyrenes, poly(vinyl) alcohols, and copolymers of the foregoing, as well as elastomeric polymers, such as elastic polyolefins, copolyether esters, polyamide polyether block copolymers, ethylene vinyl acetates (EVA), block copolymers having the general formula A-B-A' or A-B like copoly(styrene/ethylene-butylene), styrene-poly(ethylene-propylene)-styrene, styrene-poly(ethylene-butylene)-styrene, (polystyrene/poly(ethylene-butylene)/polystyrene, poly (styrene/ethylene-butylene/styrene), A-B-A-B tetrablock copolymers and the like.

For instance, some suitable examples of polyolefins that can be used include, but are not limited to, polyethylene, e.g., Dow Chemical's PE XU 61800.41 linear low density polyethylene ("LLDPE") and 25355 and 12350 high density polyethylene ("HDPE"); polypropylene, e.g., Exxon Chemical Company's Escorene® PD 3445 polypropylene and Montell Chemical Co.'s PF-304 and PF-015; polybutylene; and the like. Many other polyolefins are commercially available as well.

The synthetic fibers added to the web can also include staple fibers which can be added to increase the strength, bulk, softness and smoothness. Staple fibers can include, for instance, various polyolefin fibers, polyester fibers, nylon fibers, polyvinyl acetate fibers, cotton fibers, rayon fibers, non-woody plant fibers, and mixtures thereof.

Besides or in addition to synthetic fibers, pulp fibers can also be used in the present invention. The pulp fibers used in forming the web may be softwood fibers having an average fiber length of greater than 1 mm, and particularly from about 2 to 5 mm based on a length-weighted average. Such fibers can include Northern softwood kraft fibers, redwood fibers and pine fibers. Secondary fibers obtained from recycled materials may also be used. In addition, hardwood pulp fibers, such as eucalyptus fibers, can also be utilized in the present invention.

Besides the above-mentioned fibers, thermomechanical pulp fibers can also be added to the base web. Thermomechanical pulp, as is known to one skilled in the art, refers to pulp that is typically cooked during the pulping process to a lesser extent than conventional pulps. Thermomechanical pulp tends to contain stiff fibers and has higher levels of lignin. Thermomechanical pulp may help to create an open pore structure in the web, thus increasing bulk and absorbency and improving resistance to wet collapse.

In general, the wiping product of the present invention can be made exclusively from synthetic fibers or from a mixture of synthetic fibers and other materials. For example, in one embodiment, a wiping product of the present invention can be made from synthetic fibers and pulp fibers. When utilizing synthetic fibers, such as polyolefin fibers, in conjunction with pulp fibers, the synthetic fibers can generally be added to the web in any amount desired. For example, in one embodiment, polyolefin fibers are added in an amount of at least about 20% by weight of the web, particularly at least about 40% by weight of the web, and more particularly at least about 60% by weight of the web.

In accordance with the present invention, the nonwoven web can be bonded using a microcreping process. Microcreping is a mechanical compaction process normally used to soften a web. For instance, some suitable microcreping processes are described in U.S. Pat. Nos. 3,260,778 to Walton; 4,919,877 to Parsons, et al.; 5,102,606 to Ake, et al.; 5,498,232 to Scholz; and 5,972,039 to Honeycutt, et al., which are all incorporated herein in their entirety by reference thereto for all purposes. Moreover, commercially available microcreping equipment may also be obtained from Micrex Corporation of Walpole, Mass.

In accordance with the present invention, it has been discovered that microcreping a nonwoven web containing melt-spun fibers can bond the fibers to increase the strength of the web. Specifically, the frictional forces associated with microcreping can cause the temperature of the web surface to be raised. As a result, the fibers within the web can bond together to increase strength. Moreover, because microcreping does not create substantial areas of melted polymer, the resulting web can have improved functionality, i.e., bulk, absorbent capacity, etc.

Figure 2:
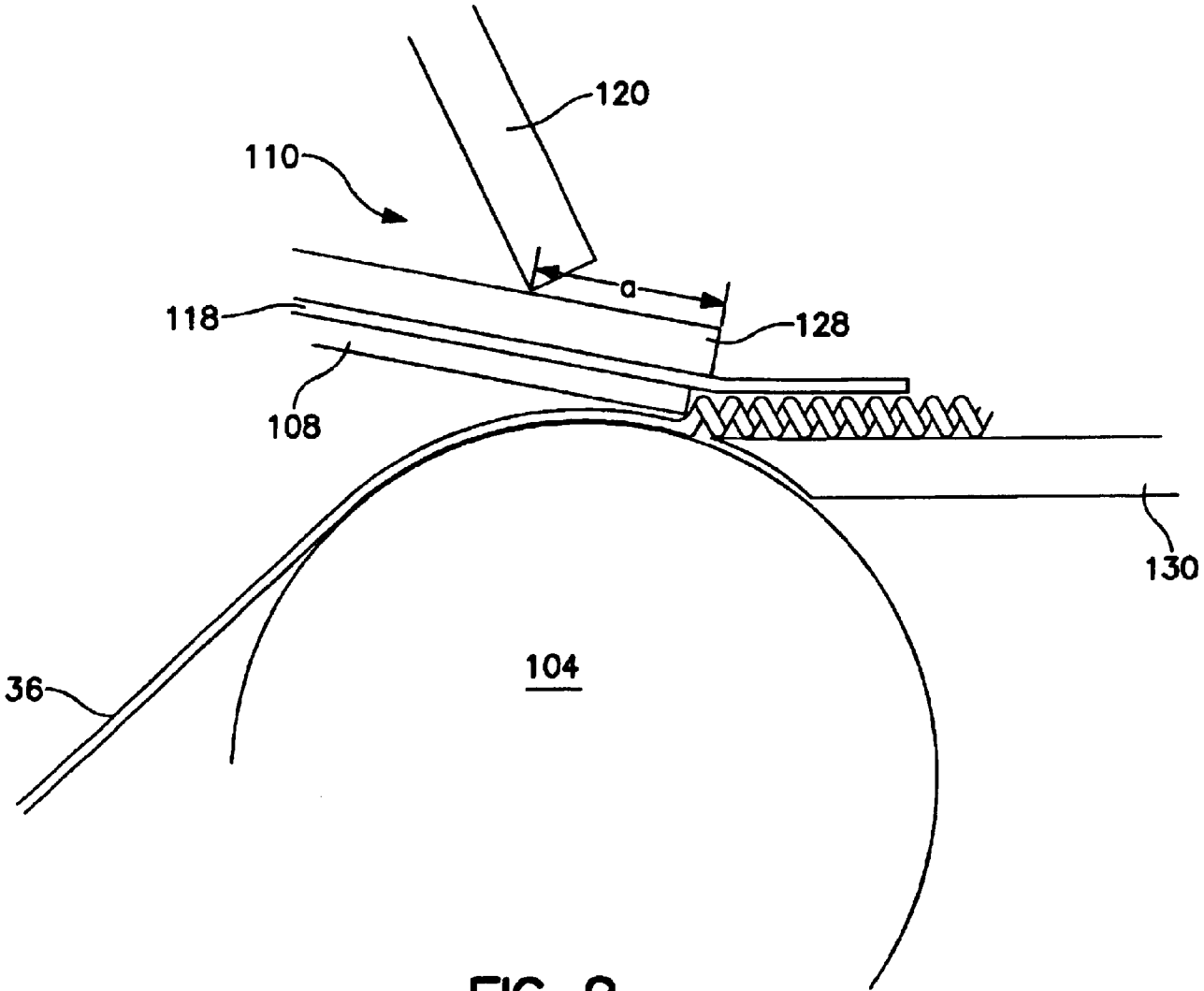
FIG. 2 is an enlarged schematic view of the treatment zone shown in FIG. 1.

Referring to FIGS. 1–2, for example, one embodiment of the present invention will now be described in greater detail. In particular, one embodiment of a microcreping process is illustrated in which a nonwoven web 36 is provided by a supply roll 100. In some embodiments, the nonwoven web 36 can be a single web layer formed from a meltblown or coform material containing polyolefins or other melt-spinnable polymers. In other embodiments, the nonwoven web 36 can be a multilayered web that may contain a first layer formed from a meltblown or coform material containing polyolefin or other melt-spinnable polymers and a second layer formed from any other material. For instance, the second layer can be formed from a meltblown, spunbond, coform, or carded material.

As shown, the nonwoven web 36 is unwound from the supply roll 100 and engaged by the surface of a rotating drum roll 104. The drum roll 104 carries the web 36 into a passage 106 of a treatment zone 110. Upon leaving the treatment zone 110, the web 36 is then directed to a converting operation and temporarily wound onto a roll (not shown), if desired.

As stated, the nonwoven web 36 is transferred to the surface of the rotating drum roll 104, which can engage the web 36 and carry it through the treatment zone 110. In most embodiments, the wet web 36 engages the drum roll 104 without the use of any adhering aids, such as binder fibers or adhesives. Nevertheless, in some embodiments, adhering aids may be used in certain circumstances if desired.

For example, in one embodiment, the web 36 can contain binder fibers that allow the web to engage the roll 104 when heated to a certain temperature. As used herein, a binder fiber refers to a fiber that will thermally bond with other fibers when heated and pressed together. Binder fibers, which are typically synthetic fibers, will flow under pressure when heated above a softening point, while also retaining their structural characteristics. For example, some suitable binder fibers can include, for instance, various synthetic fibers, such as fibers made from polyolefins. For instance, in one embodiment, the binder fibers are made from polyethylene or polypropylene. These fibers will typically fuse and bond together within a temperature range of from about 100° F. to about 325° F. without melting. In general, the amount of binder fibers contained within the web, can, in some embodiments, be present in an amount of at least about 5% by weight, particularly from about 5% to about 60% by weight, and more particularly from about 10% to about 40% by weight.

In some embodiments, adhesives can also be used to adhere the web 36 to the rotating drum roll 104. Some examples of suitable adhesives include, but are not limited to, acrylates, styrene butadiene, vinyl chlorides, methacrylates, acrylics (such as carboxylated acrylics), and vinyl acetates (such as self cross-linking ethyl vinyl acetate, hydrolyzed polyvinyl acetate, or non cross-linking ethyl vinyl acetate). In certain embodiments, the adhesive can be a carboxylated acrylic, such as a HYCAR-brand acrylic carboxylated latex.

When utilized, the adhesives can be applied to the web in a variety of ways. In one embodiment, for example, the adhesive can be applied to the web in a preselected pattern, such as a reticular pattern, diamond shaped grid, succession of discrete dots, combinations thereof, and the like. Moreover, the adhesive can also be applied to one or both sides of the web so as to cover less than 100% of the surface area of the web, particularly from about 10% to about 60% of the surface area of the web, and more particularly, from about 20% to about 40% of the web.

Referring again to FIGS. 1–2, within the treatment zone 110, the web 36 first passes under the primary blade 108 and becomes compressed in the -z direction between the primary blade 108 and the surface of the drum roll 104. Pressure is applied by the corner edge of a pressure plate 120 and is transmitted to the primary blade 108 through an optional back-up blade 128 and a flexible retarder blade 118 positioned in an offset, stepwise configuration. The stepwise configuration can provide an operating window in which the pressure transmitted to the web 36 can be more easily controlled by distributing the pressure over a larger surface area.

As the web 36 passes under the end of the primary blade 108, it contacts the operating face of a blade 130, which can cause the web 36 to become compressed in a lengthwise direction because the web 36 cannot expand in the -z direction due to the constraining forces provided by the surface of the primary blade 108. However, it should be understood that some or all of the features of the microcreping process described above may or may not be required in certain applications. For instance, in some embodiments, the blades 118 and 128 are not utilized.

In general, the extent of microcreping can vary as understood by one skilled in the art. For example, by increasing the degree of microcreping, the bulk of the nonwoven web can be increased. However, in some embodiments, it may be desired to control the extent of microcreping so that the strength of the web is also not substantially reduced. For example, in some embodiments, the microcreped fabric can have an extensibility in the lengthwise direction of less than about 30%, and particularly between about 5% to about 25%.

A variety of microcreping parameters may be selectively varied to alter the extent of microcreping. For instance, a microcreping machine available from Micrex Corporation can be provided with varying creping conditions as is known in the art. In one embodiment, for example, a comb roll mode, a flat roll mode, etc., can be utilized for the Micrex machinery. Moreover, the number of primary blades, back-up blades, and retarder blades can be selectively varied. For instance, in one embodiment, two retarder blades can be utilized such that each is positioned between two primary blades. Moreover, if desired, the distance between the retarder and primary blade(s) may also be varied as is known in the art. The pressure provided by the pressure plate can also be varied if desired. In addition other parameters, such as the blade geometry, the thickness of the blades, the angle of the retarder blade, the speed of the roll 104 and the rewind roll (not shown), etc., can be varied. For example, in some embodiments, the distance "a" between the pressure plate 120 and the backup blade 128 can be between about 0.5 inches to about 2 inches. Moreover, in some embodiments, the distance that the retarder blade 118 extends beyond the backup blade 128 is between about 2.5 inches to about 4 inches. The resulting crepe amplitude can vary, but is typically between about 8 to about 16 bars per inch.

Moreover, in some embodiments, heat and/or moisture can be supplied to the web 36, thereby raising the temperature of the web to reduce strength degradation. For example, the temperature may be increased by heating the drum roll 104 during microcreping. The use of heat and/or moisture in a microcreping process is described, for example, in U.S. Pat. No. 4,919,877 to Parsons, et al.

In some embodiments, the other side of web 36 can also be microcreped. For example, upon microcreping one side of the web on the drum roll 104, the web 36 can then be transferred to another drum roll (not shown) for microcreping the other side of the web 36 as described above. By microcreping each side of the web 36, the bonding of the fibers contained therein can be further ensured.

As a result of microcreping in accordance with the present invention, the functionality (i.e., bulk, absorption capacity, etc.) of a resulting nonwoven web can generally be improved. In particular, microcreping allows the fibers contained within the nonwoven web to be bonded without creating substantial areas where the polymer is melted. Therefore, the nonwoven web can retain a greater area of unmelted polymer for functional reasons. In particular, by bonding the web using microcreping, the nonwoven web can have improved absorbent capacity over nonwoven webs bonded solely by other methods.

After microcreping the web, it may then be further processed utilizing other suitable techniques known in the art. For example, in some instances, after being microcreped, the web 36 can then be cut into commercially sized sheets for packaging as a wiping product. Moreover, in other instances, various additives can be added to the nonwoven web after and/or before it is microcreped. In particular, any additive can generally be applied to the nonwoven web at any point during its formation. Some examples of suitable additives can include, but are not limited to, surfactants, adhesives, antistatic agents, humectants, flame retardant agents, plasticizers, thickeners, defoamers, composite particles, viscosity modifiers, stabilizers, antimicrobial agents, debonding agents, colorants, combinations thereof, and the like.

In addition, in some embodiments, the microcreped web 36 may be further bonded using microcreping or other techniques, as long as such techniques do not substantially adversely affect the absorbency and/or softness of the nonwoven web. For instance, one bonding method that may sometimes be used is thermal bonding, such as described in U.S. Pat. No. 3,855,046 to Hansen et al, which is incorporated herein by reference for all purposes. In addition, other well known methods of bonding, such as oven-bonding, ultrasonic bonding, hydroentangling, needling, adhesive bonding, stitch-bonding, through-air bonding, or combinations of such techniques, may be utilized in certain instances.

The basis weight of wiping products made according to the present invention can generally range from about 20 to about 200 grams per square meter (gsm), particularly from about 35 to about 150 gsm, and more particularly between about 50 to about 140 gsm. Lower basis weights, for example, may be more useful for light duty wipers, while higher basis weights may be more useful for heavy-duty wipers.

The present invention may be better understood with reference to the following example.

EXAMPLE

The ability of a nonwoven web of the present invention to possess improved properties was demonstrated. A wiping cloth sample having a basis weight of 74 grams per square meter (gsm) was obtained from Kimberly-Clark under the tradename KIMCEL®. KIMCEL® is a three-layered nonwoven laminate having two outer layers formed from a coform web and an inner layer formed from a meltblown web. Each coform web was formed with pulp fibers in an amount of about 30% by weight of the web and polypropylene in an amount of about 70% by weight of the web, while the meltblown web was formed from polypropylene. The webs were then bonded using conventional bonding techniques.

Various properties of the 74-gsm sample were then tested for comparative purposes. The properties of these comparative samples are listed below in Table 1 as Sample A.

Thereafter, four samples (i.e., B–E) were formed from the same materials and layers as the comparative sample A. However, instead of being bonded using conventional bonding techniques, one side of the samples B–E was microcreped using flat blade microcreping equipment obtained from Micrex Corporation of Walpole, Mass. The microcreping parameters for each of the samples were varied within the standard range recognized in the art. For example, between 1 to 6 backup blades were used, the distance between the pressure plate and the backup blade(s) was varied between about 0.5 inches to about 2 inches ("a" in FIG. 2), and the distance that the retarder blade extended beyond the backup blade(s) was varied between about 2.5 inches to about 4 inches. The resulting crepe amplitude was between about 8 to about 16 bars per inch. After microcreping the samples, various properties were then determined. The properties of the samples B–E are also listed below in Table 1.

A fifth sample (i.e., F) was also formed from the same materials and layers as the samples B–E. However, both sides of the sample F were microcreped using the microcreping equipment obtained from Micrex Corporation of Walpole, Mass.

After microcreping both sides of the sample, various properties were then determined. The properties of the sample F are also listed below in Table 1.

TABLE 1

| | Properties of Nonwoven Web Samples | | | | | |
|---|---|---|---|---|---|---|
| Web Properties | A | B | C | D | E | F |
| Basis Wt. (gsm) | 74.6 | 121.3 | 135.6 | 140.5 | 124.8 | 93.9 |
| Bulk (dry) | 0.82 | 1.13 | 1.52 | 1.22 | 1.20 | 0.89 |
| Bulk (wet) | 0.79 | 1.11 | 1.51 | 1.31 | 1.31 | 0.87 |
| MD (dry) Tensile Strength (g) | 2712 | 2200 | 1895 | 1940 | 1750 | 1885 |
| CD (wet) Tensile Strength (g) | 2220 | 2490 | 2442 | 2008 | 2213 | 1810 |
| Water Absorption Rate (secs) | 3.7 | 0.6 | 0.9 | 1.9 | 0.4 | 0.6 |
| Water Absorption Capacity (gsm) | 480 | 514 | 687 | 687 | 646 | 312 |
| Stiffness MD-dry (cm) | 4.27 | 1.59 | 1.09 | 1.41 | 1.69 | 2.49 |
| Stiffness CD-dry (cm) | 3.20 | 3.66 | 4.22 | 3.64 | 3.73 | 4.56 |

The above tests performed on the samples were done according to conventional methods that are known in the art.

As indicated in Table 1, various properties, such as bulk and absorption capacity, can be increased by microcreping the web in accordance with the present invention. Moreover, such improved properties can be accomplished without substantially depleting the strength of the web.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method of forming a wiping product, said method comprising:

providing a nonwoven web that contains at least about 20% by weight meltblown fibers, said nonwoven web defining a first side and a second side; and bonding said nonwoven web by microcreping said first side of said web, said second side of said web, or both, wherein said bonded nonwoven web defines an outer surface of the wiping product.

2. A method as defined in claim 1, wherein said meltblown fibers are polyolefin fibers.

3. A method as defined in claim 1, wherein said nonwoven web contains at least about 40% by weight of said meltblown fibers.

4. A method as defined in claim 1, wherein said nonwoven web contains at least about 60% by weight of said meltblown fibers.

5. A method as defined in claim 1, wherein said nonwoven web further contains a material selected from the group consisting of pulp fibers, thermomechanical pulp fibers, staple fibers, superabsorbent materials, and combinations thereof.

6. A method as defined in claim 5, wherein said nonwoven web contains pulp fibers.

7. A method as defined in claim 1, wherein said second side of said nonwoven web defines another outer surface of the wiping product.

8. A method as defined in claim 7, further comprising microcreping said second side of said nonwoven web.

9. A method as defined in claim 1, wherein the wiping product contains multiple layers, wherein one of said layers is formed by said nonwoven web and another of said layers is formed by an additional nonwoven web.

10. A method as defined in claim 9, wherein a first side of said additional nonwoven web defines another outer surface of the wiping product.

11. A method as defined in claim 10, further comprising microcreping said first side of said additional nonwoven web.

12. A method as defined in claim 9, wherein said additional nonwoven web contains melt-spun fibers.

13. A method as defined in claim 1, wherein the wiping product has an extensibility of from about 5% to about 30% in the lengthwise direction.

14. A method as defined in claim 1, wherein the wiping product has an extensibility of from about 5% to about 25% in the lengthwise direction.

15. A method of forming a wiping product, said method comprising:

providing a nonwoven web that contains at least 40% by weight meltblown fibers, said nonwoven web defining a first side and a second side; and bonding said nonwoven web by microcreping said first side of said web, said second side of said web, or both, wherein said bonded nonwoven web defines an outer surface of the wiping product, and wherein the wiping product has an extensibility of from about 5% to about 30% in the lengthwise direction.

16. A method as defined in claim 15, wherein said meltblown fibers are polyolefin fibers.

17. A method as defined in claim 15, wherein said nonwoven web further contains a material selected from the group consisting of pulp fibers, thermomechanical pulp fibers, staple fibers, superabsorbent materials, and combinations thereof.

18. A method as defined in claim 15, wherein said second side of said nonwoven web defines another outer surface of the wiping product.

19. A method as defined in claim 18, further comprising microcreping said second side of said nonwoven web.

20. A method as defined in claim 15, wherein the wiping product contains multiple layers, wherein one of said layers is formed by said nonwoven web and another of said layers is formed by an additional nonwoven web.

21. A method as defined in claim 20, wherein a first side of said additional nonwoven web defines another outer surface of the wiping product.

22. A method as defined in claim 21, further comprising microcreping said first side of said additional nonwoven web.

23. A method as defined in claim 20, wherein said additional nonwoven web contains melt-spun fibers.

24. A method as defined in claim 15, wherein the wiping product has an extensibility of from about 5% to about 25% in the lengthwise direction.

25. A method of forming a wiping product comprising:

providing a nonwoven web that contains at least 40% by weight meltblown fibers, said nonwoven web defining a first side and a second side; and bonding said nonwoven web by a method consisting essentially of microcreping said first side of said web, said second side of said web, or both, wherein said bonded nonwoven web defines an outer surface of the wiping product, and wherein the wiping product has an extensibility of from about 5% to about 30% in the lengthwise direction.

26. A method as defined in claim 25, wherein said meltblown fibers are polyolefin fibers.

27. A method as defined in claim 25, wherein said second side of said nonwoven web defines another outer surface of the wiping product.

28. A method as defined in claim 25, wherein the wiping product contains multiple layers, wherein one of said layers is formed by said nonwoven web and another of said layers is formed by an additional nonwoven web.

29. A method as defined in claim 25, wherein the wiping product has an extensibility of from about 5% to about 25% in the lengthwise direction.

30. A method of forming a fabric comprising:

providing a first nonwoven web containing melt-spun fibers, said first nonwoven web having a first side and a second side, said first side of said first nonwoven web defining a first outer surface of the fabric and said second side of said first nonwoven web defining a second outer surface of the fabric; and bonding said first nonwoven web by microcreping said first side and said second side of said first nonwoven web along at least one of its planar dimensions.

31. A method as defined in claim 30, wherein said melt-spun fibers are meltblown fibers.

32. A method as defined in claim 30, wherein said melt-spun fibers are polyolefin fibers.

33. A method as defined in claim 30, wherein said nonwoven web contains at least about 20% by weight of said melt-spun fibers.

34. A method as defined in claim 30, wherein said nonwoven web contains at least about 40% by weight of said melt-spun fibers.

35. A method as defined in claim 30, wherein the fabric has an extensibility from about 5% to about 30% in the lengthwise direction.

36. A method as defined in claim 30, wherein the fabric has an extensibility from about 5% to about 25% in the lengthwise direction.

37. A method of forming a fabric having multiple layers, wherein one of said layers comprises a first nonwoven web containing melt-spun fibers, said first nonwoven web having a first side and a second side, wherein another of said layers comprises a second nonwoven web containing melt-spun fibers said second nonwoven web having a first side and a second side, wherein said first side of said first nonwoven web defines a first outer surface of the fabric, said method comprising bonding said first nonwoven web by microcreping said first side of said first nonwoven web along at least one of its planar dimensions.

38. A method as defined in claim 37, wherein said melt-spun fibers are meltblown fibers.

39. A method as defined in claim 37, wherein said melt-spun fibers are polyolefin fibers.

40. A method as defined in claim 37, wherein said nonwoven web contains at least about 20% by weight of said melt-spun fibers.

41. A method as defined in claim 37, wherein said nonwoven web contains at least about 40% by weight of said melt-spun fibers.

42. A method as defined in claim 37, wherein the fabric has an extensibility from about 5% to about 30% in the lengthwise direction.

43. A method as defined in claim 37, wherein the fabric has an extensibility from about 5% to about 25% in the lengthwise direction.

* * * * *